US007511690B2

(12) United States Patent
Baek

(10) Patent No.: US 7,511,690 B2
(45) Date of Patent: Mar. 31, 2009

(54) DISPLAY DEVICE AND DRIVING METHOD THEREOF

(75) Inventor: Heum-Il Baek, Seoul (KR)

(73) Assignee: LG Display Co., Ltd., Seoul (KR)

( * ) Notice: Subject to any disclaimer, the term of this patent is extended or adjusted under 35 U.S.C. 154(b) by 724 days.

(21) Appl. No.: 10/878,546

(22) Filed: Jun. 29, 2004

(65) Prior Publication Data

US 2005/0140612 A1 Jun. 30, 2005

(30) Foreign Application Priority Data

Dec. 29, 2003 (KR) ..... 10-2003-0098680

(51) Int. Cl.
*G09G 3/36* (2006.01)

(52) U.S. Cl. ..... 345/88; 345/690

(58) Field of Classification Search ..... 345/88, 345/690, 87, 589–591, 597; 348/246, 761, 348/225, 227, 228, 242, 245, 247, 739, 751, 348/760

See application file for complete search history.

(56) References Cited

U.S. PATENT DOCUMENTS 6,724,934 B1 * 4/2004 Lee et al. ..... 382/167
6,744,534 B1 * 6/2004 Balasubramanian et al. . 358/1.9
7,027,105 B2 * 4/2006 Lee et al. ..... 348/687
7,151,517 B2 * 12/2006 Lee ..... 345/88
7,167,150 B2 * 1/2007 Yang et al. ..... 345/89
2003/0090455 A1 * 5/2003 Daly ..... 345/102
2003/0151694 A1 * 8/2003 Lee et al. ..... 348/687
2004/0046725 A1 * 3/2004 Lee ..... 345/88
2005/0099426 A1 * 5/2005 Primerano et al. ..... 345/589

OTHER PUBLICATIONS

Seong Deok Lee, et al., "Color Conversion from RGB to RGB+White While Preserving Hue and Saturation," Tenth Color Imaging Conference, 2002, pp. 287-291.

* cited by examiner

*Primary Examiner*—Amr Awad
*Assistant Examiner*—Stephen G Sherman
(74) *Attorney, Agent, or Firm*—Morgan Lewis & Bockius LLP

(57) ABSTRACT

A display device and a driving method thereof includes categorizing red-color, green-color, and blue-color image signals as belonging to one of first and second signal regions, detecting if the image signals have more signals belonging to the first signal region than the second signal region or if the image signals have more signals belonging to the second signal region than the first signal region, driving an image display portion in a first manner if the image signals are detected to have more signals belonging to the first signal region than the second signal region, and driving the image display portion in a second manner if the image signals are detected to have more signals belonging to the second signal region than the first signal region, the image display portion including a plurality of pixels, each of the pixels having red-color, green-color, blue-color, and white-color sub-pixels.

20 Claims, 10 Drawing Sheets

RGB arrangement

RGBW arrangement

DISPLAY DEVICE AND DRIVING METHOD THEREOF

The present invention claims the benefit of Korean Patent Application No. 2003-98680 filed in Korea on Dec. 29, 2003, which is hereby incorporated by reference.

BACKGROUND OF THE INVENTION

1. Field of the Invention

The present invention relates to a display device and a driving method thereof, and more particularly, to a display device having a pixel comprising red-color, green-color, blue-color, and white-color sub-pixels and a driving method thereof.

2. Discussion of the Related Art

Until recently, display devices generally employed cathode-ray tubes (CRTs) or television monitors. Presently, many efforts are being made to study and develop various types of flat panel displays, such as liquid crystal display devices (LCDs), plasma display panel (PDPs), field emission displays, and electro-luminescence displays (ELDs), as substitutions for CRTs because of their high resolution images, lightness, thin profile, compact size, and low voltage power supply requirements. In general, such a display device displays video information with a plurality of pixels arranged in a matrix type, and a pixel has red-color, green-color, and blue-color sub-pixels. In addition, in a display device, a pixel has red-color, green-color, blue-color and white-color sub-pixels.

FIGS. 1A and 1B are views of pixel arrangements according to the related art. In FIG. 1A, an RGB pixel arrangement includes red-color, green-color and blue-color sub-pixels, "R", "G", and "B", arranged along a row to constitute a first pixel Pa. The first pixel Pa has a pixel area A. Thus, a size of each of the sub-pixels in the RGB arrangement is ⅓ A. In addition, the red-color, green-color and blue-color sub-pixels, "R", "G", and "B", have a red-color filter, a green-color filter, and a blue-color filter formed therein, respectively. Further, the RGB arrangement emits white light by emitting red-color, green-color and blue-color light together. Thus, when light luminance is "Y" and transmittance of the color filters is ⅓, the luminance output of the pixel Pa is Y×⅓ for red-color, green-color, blue-color, and white-color light. Thus, assuming the luminance output of the RGB pixel arrangement 1, Y=3.

In FIG. 1B, an RGBW pixel arrangement includes red-color, green-color, blue-color, and white-color sub-pixels, "R", "G", "B", and "W", arranged along a row to constitute a second pixel Pb. The second pixel Pb also has the same pixel area A as the first pixel Pa. Thus, a size of each of the sub-pixels in the RGBW arrangement is ¼ A. That is, the sub-pixel size ratio between the RGBW arrangement and the RGB arrangement is 1:¾. As a result, the luminance of the red-color, green-color, and blue-color sub-pixels in the RGBW arrangement is ¾ of the luminance of the red-color, green-color, and blue-color sub-pixels in the RGB arrangement.

However, the white-color sub-pixel in the RGBW pixel arrangement does not have a color filter. Thus, light luminance is outputted through the white-color sub-pixel without reduction by a color filter. That is, the white luminance output in RGBW arrangement is {Y×⅓×0.75}(contribution of R, G, and B)+{Y×0.25}(contribution of W). Assuming the white luminance output of the RGB pixel arrangement 1 and Y=3, the white luminance output in the RGBW arrangement is (3×⅓×0.75+3×0.25)=1.5. As a result, the white luminance of the RGBW arrangement is 1.5 times brighter than the white luminance of the RGB arrangement.

FIGS. 2 and 3 are views of color space of the pixel arrangements in FIGS. 1A and 1B, respectively. In FIG. 2, light luminance of red-color, green-color and blue-color sub-pixels in the RGB pixel arrangement shown in FIG. 1A, "r'", "g'", and "b'", have the same luminance value. Thus, the color space of the RGB pixel arrangement is a cubic region.

In FIG. 3, light luminance of red-color, green-color and blue-color sub-pixels in the RGBW pixel arrangement shown in FIG. 1B, "r", "g", and "b" also have the same luminance value. However, the color space of the RGBW pixel arrangement is a hexahedron region having a third quarter volume as many as the RGB color space along a line "0-w" from "w" to "2w," the hexahedron region {(0, 0, 0), (r, 0, 0), (0, g, 0), (0, 0, b), (r, g, 0), (r, 0, b), (0, g, b), and (r, g, b)(or w)} in RGB coordinates because the RGBW color space has higher white luminance than red, green, and blue luminance.

FIG. 4 is a view of an RG-plane projection of color spaces in FIGS. 2 and 3. In FIG. 4, "e" corresponds to a line linking ((r, g, b)(or w)+(0, g, b)) and ((r, g, b)(or w)+(0, g, 0)) in FIG. 3. "f" corresponds to a line linking ((r, g, b)(or w)+(r, 0, b)) and ((r, g, b)(or w)+(r, 0, 0)) in FIG. 3.

In FIG. 4, "0-r'-w'-g'" region is a color space in RGB arrangement, "0-r-f-2w-e-g" region is a color space in RGBW arrangement. White luminance in RGBW arrangement is higher than in RGB arrangement, and red, green, and blue luminance in RGBW arrangement is lower than in RGB arrangement. White luminance is higher than red, green, and blue luminance in RGBW arrangement. Therefore, inequality of color luminance is generated.

SUMMARY OF THE INVENTION

Accordingly, the present invention is directed to a display device and a driving method thereof that substantially obviate one or more of problems due to limitations and disadvantages of the related art.

An object of the present invention is to provide a display device and a driving method thereof that prevent red-color, green-color, and blue-color luminance being lower than white-color luminance.

Another object of the present invention is to provide a quad-type display device and a driving method thereof that avoid uneven color luminance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the display device includes a signal analyzing portion categorizing red-color, green-color, and blue-color image signals as belonging to one of first and second signal regions, and detecting if the image signals have more signals belonging to the first signal region than the second signal region or if the image signals have more signals belonging to the second signal region than the first signal region, and means for driving an image display portion in a first manner if the image signals are detected to have more signals belonging to the first signal region than the second signal region, and driving the image display portion in a second manner if the image signals are detected to have more signals belonging to the second signal region than the first signal region, the image display portion including a plurality of pixels, each of the pixels having red-color, green-color, blue-color, and white-color sub-pixels.

In another aspect, the method of driving a display device includes categorizing red-color, green-color, and blue-color image signals as belonging to one of first and second signal regions, detecting if the image signals have more signals belonging to the first signal region than the second signal region or if the image signals have more signals belonging to the second signal region than the first signal region, driving an image display portion in a first manner if the image signals are detected to have more signals belonging to the first signal region than the second signal region, the image display portion including a plurality of pixels, each of the pixels having red-color, green-color, blue-color, and white-color sub-pixels, and driving the image display portion in a second manner if the image signals are detected to have more signals belonging to the second signal region than the first signal region.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1A:
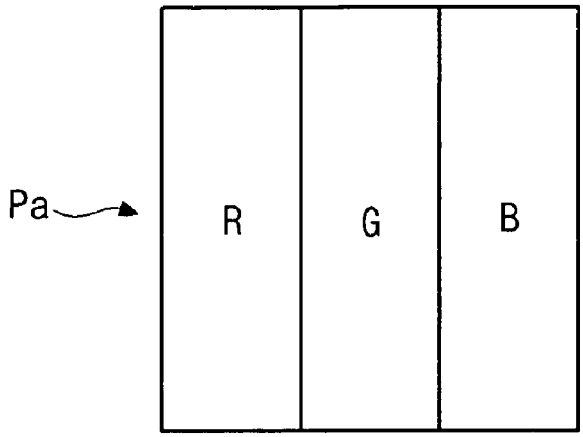
FIG. 1A RELATED ART
FIGS. 1A and 1B are views of pixel arrangements according to the related art.
Figure 1B:
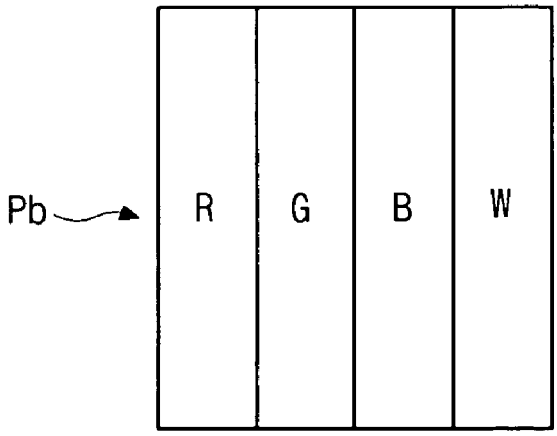
FIG. 1B RELATED ART
Figure 2:
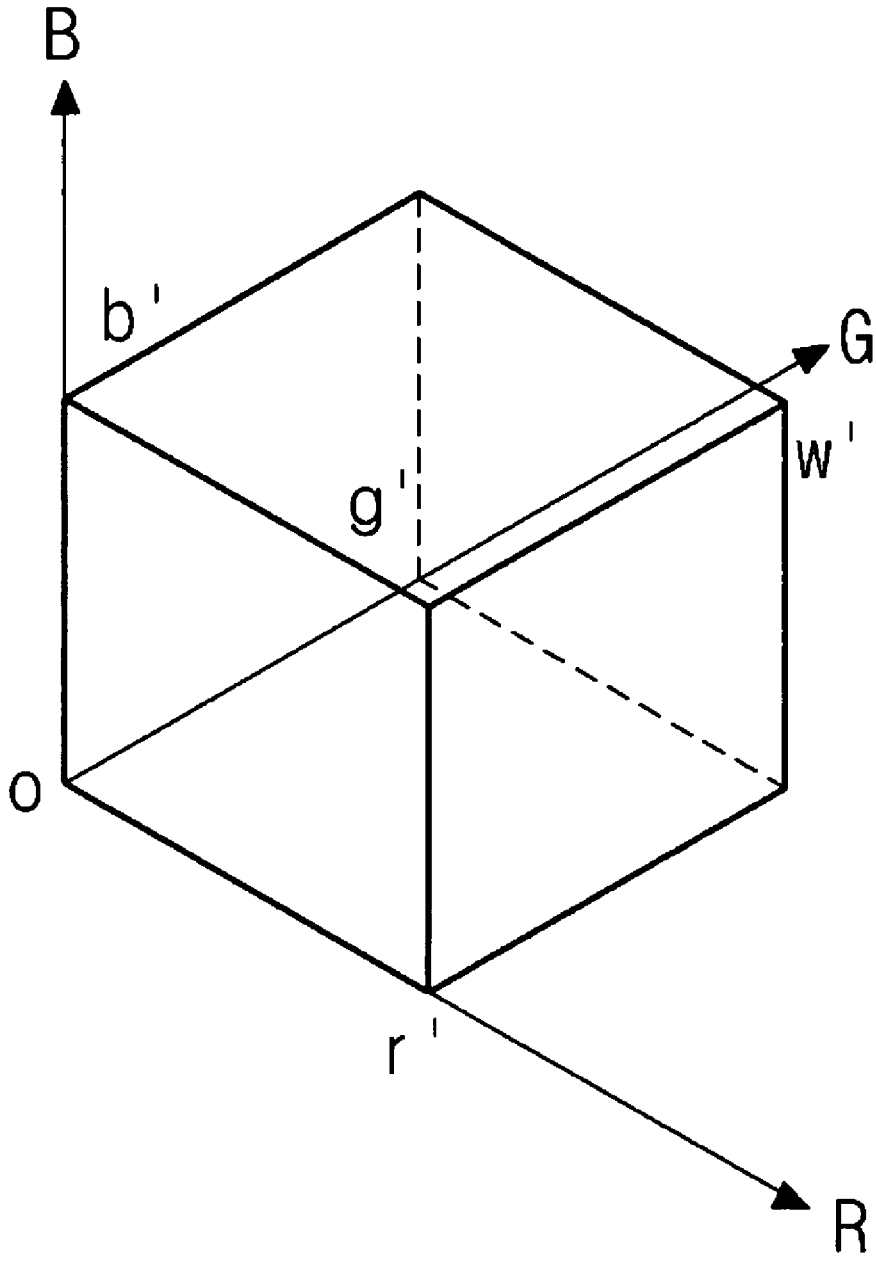
FIG. 2 RELATED ART
FIGS. 2 and 3 are views of color space of the pixel arrangements in FIGS. 1A and 1B, respectively.
Figure 3:
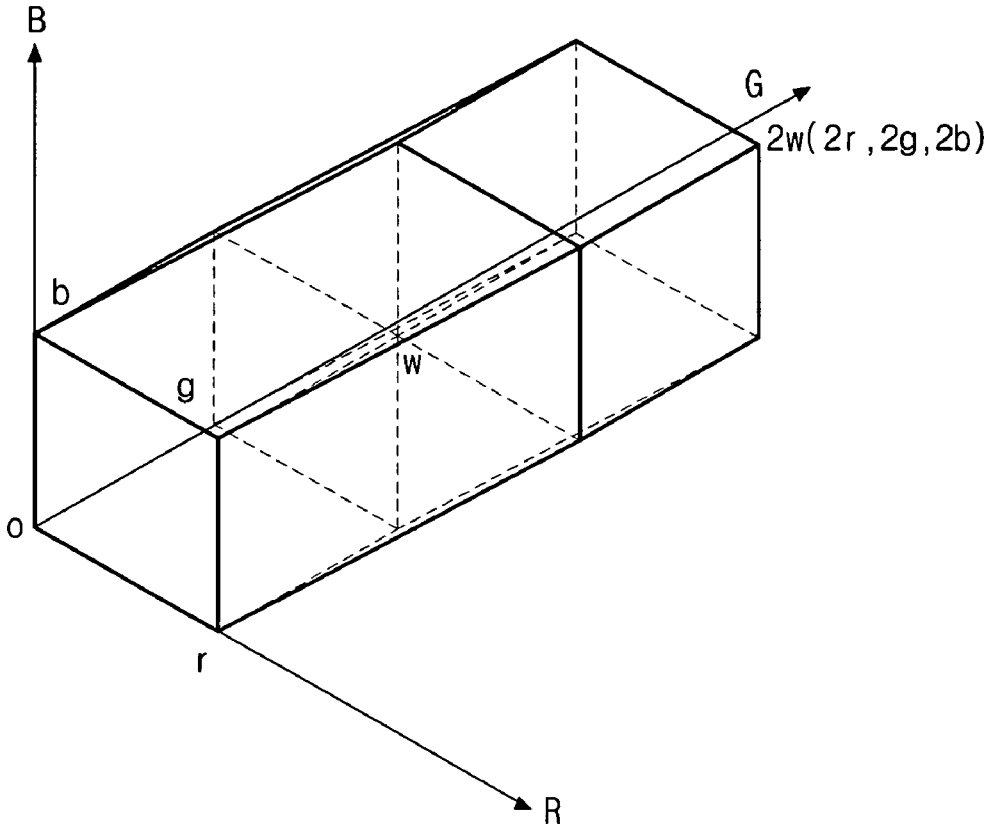
FIG. 3 RELATED ART
Figure 4:
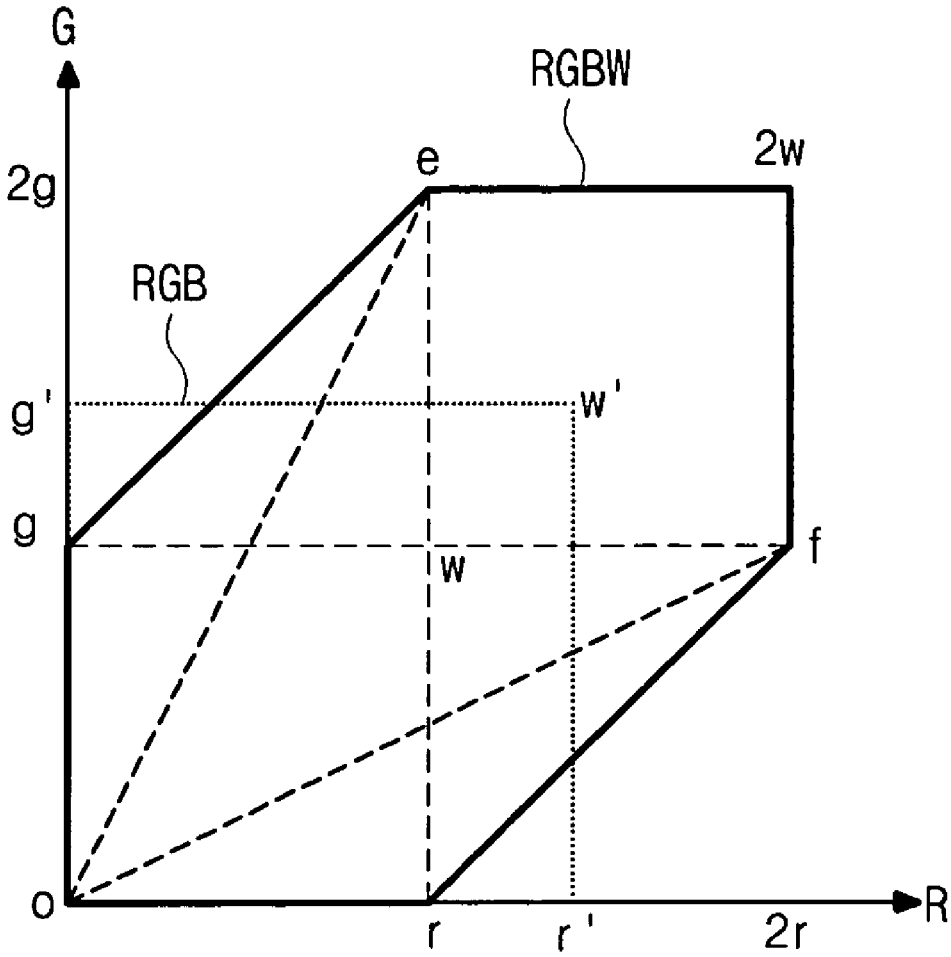
FIG. 4 RELATED ART
FIG. 4 is a view of a RG-plane projection of color spaces in FIGS. 2 and 3.
Figure 5A:
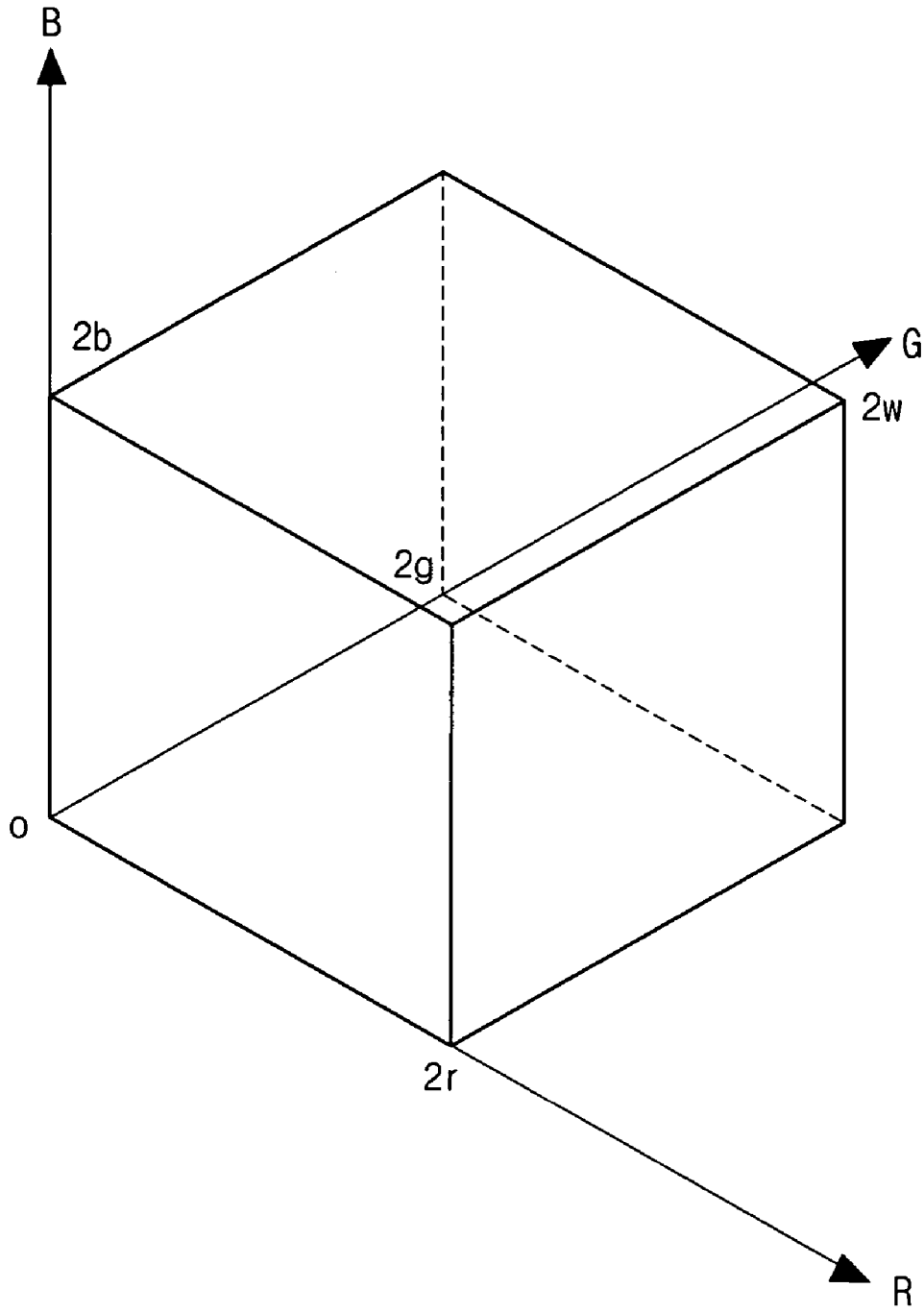
FIG. 5A is a view of a color space of a pixel arrangement of a liquid display device according to an embodiment of the present invention.
Figure 5B:
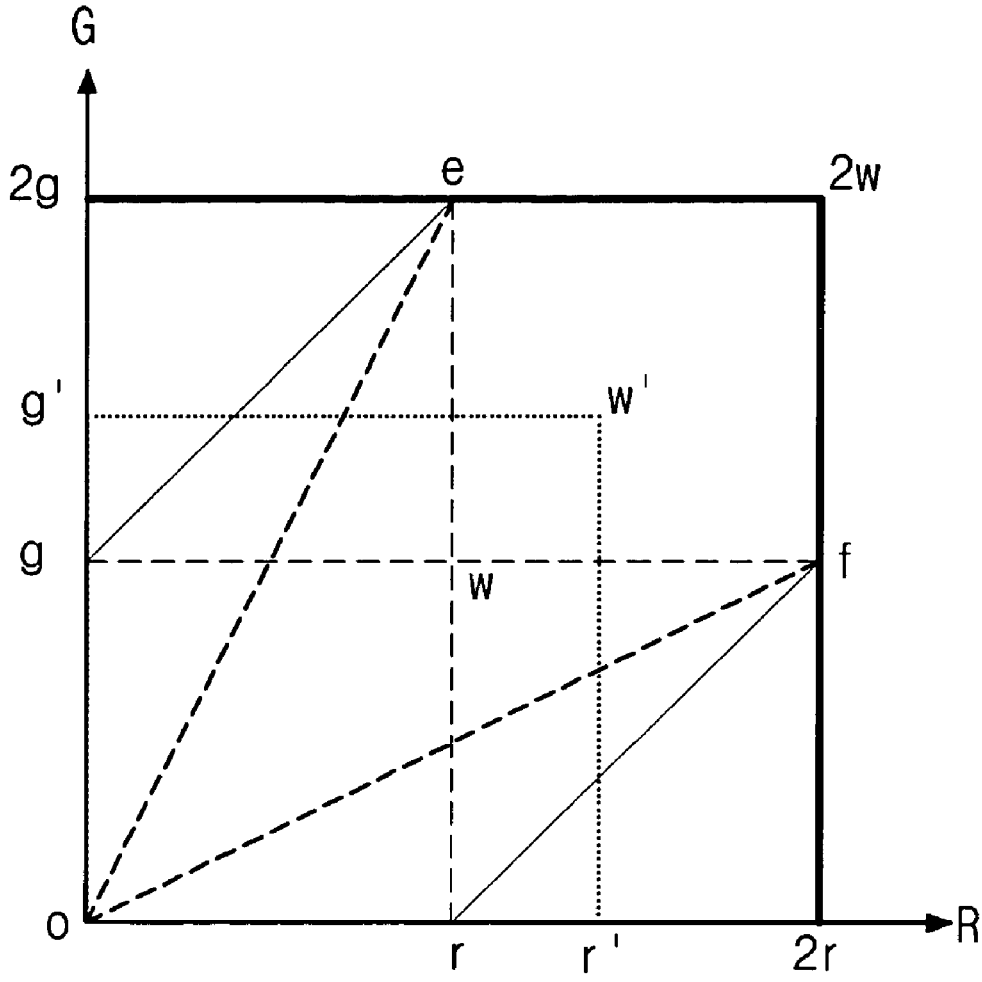
FIG. 5B is a view of the color space in FIG. 5A in the RG plane.

FIG. 5A is a view of a color space of a pixel arrangement of a liquid display device according to an embodiment of the present invention, and FIG. 5B is a view of the color space in FIG. 5A in the RG plane. As shown in FIG. 5A, a liquid crystal display device may have a pixel arrangement having RGBW sub-pixels and a color space of the pixel arrangement may be a cubical region expressed as {(0, 0, 0), (2r, 0, 0), (0, 2g, 0), (0, 0, 2b), (2r, 2g, 0), (2r, 0, 2b), (0, 2g, 2b), and (2r, 2g, 2b)} in a three-dimensional (R, B, G) coordination. The coordinate of (2r, 2g, 2b) may be alternatively expressed as (2r, 2g, 2w).

As shown in FIG. 5B, the color space may be a square region expressed as {0-2r-2w-2g} in a two-dimensional (R, G) coordination. Thus, the liquid crystal device may have luminance of red-color, green-color, and blue-color that are twice as bright as the luminance of the related art, and may have red-color, green-color, blue-color, and white-color light having a same luminance value.

Figure 6A:
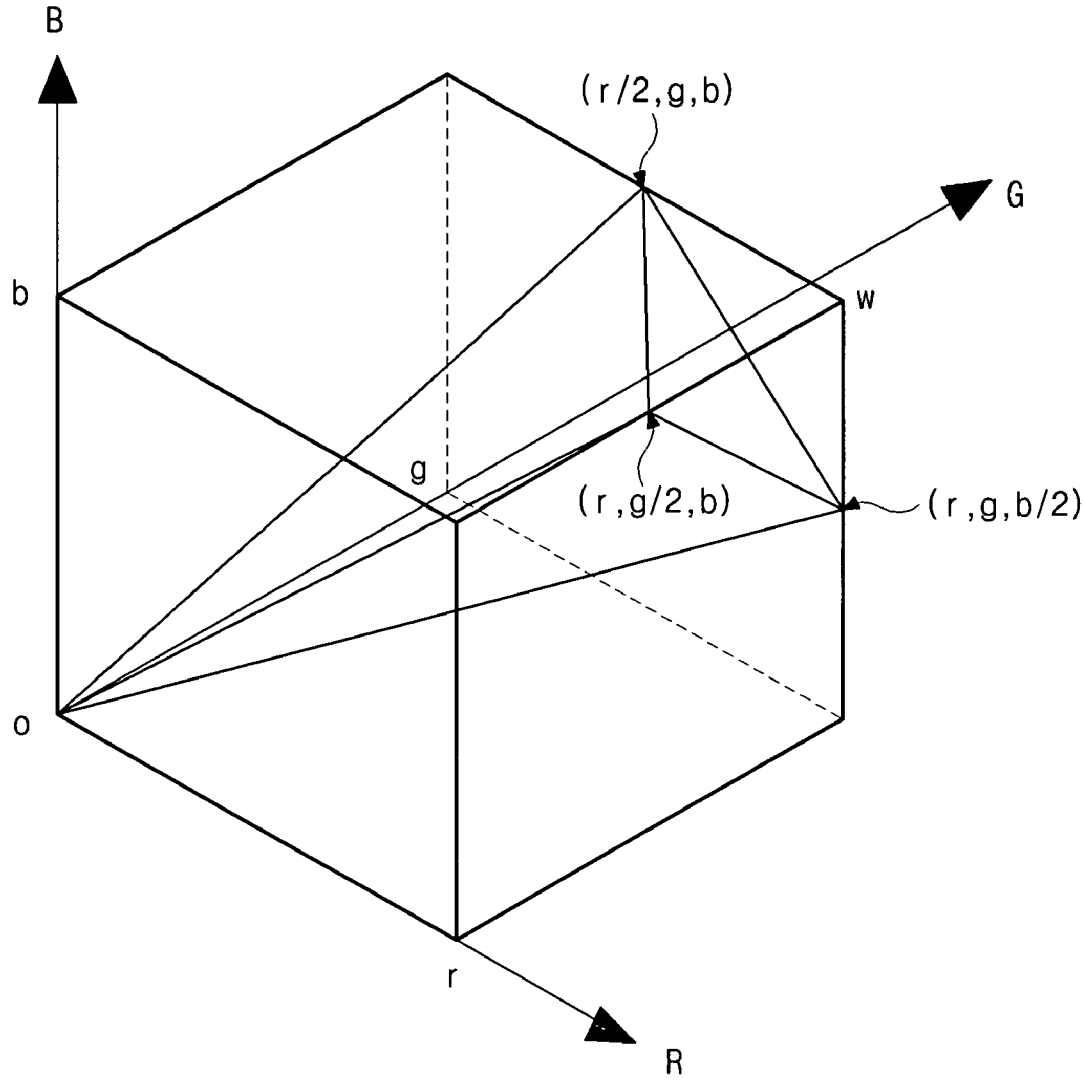
FIG. 6A is a view of an input image signal region according to an embodiment of the present invention.
Figure 6B:
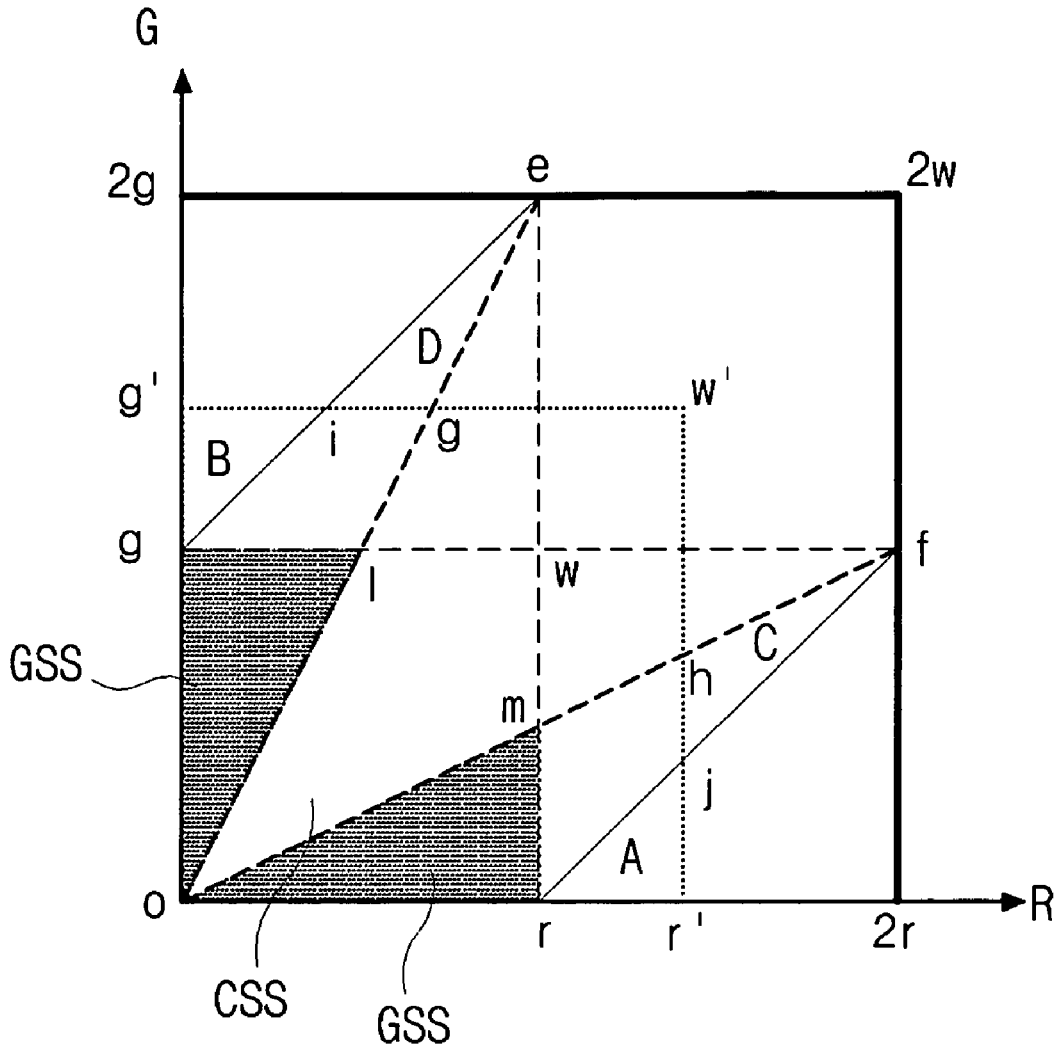
FIG. 6B is a view of a RG-plane projection of the input image signal region in FIG. 6A.

FIG. 6A is a view of an input image signal region according to an embodiment of the present invention, and FIG. 6B is a view of an RG-plane projection of the input image signal region in FIG. 6A. As shown in FIG. 6, the input image signal region is a region surrounded by (0, 0, 0), (r, 0, 0), (0, g, 0), (0, 0, b), (r, g, 0), (r, 0, b), (0, g, b), and (r, g, b)(or w) in FIG. 6A, and a region "0-r-w-g" in FIG. 6B.

The input image signal region may be divided by a CSS (Constant Scaling Space) signal region and a GSS (Gamut Scaling Space) signal region. For example, the CSS signal region may be a region surrounded by (0, 0, 0), (r/2, g, b), (r, g/2, b), (r, g, b/2), and (r, g, b)(or w) in FIG. 6A, and a region "0-m-w-1" in FIG. 6B. "m" and "1" in FIG. 6A correspond to (r/2, g, b) and (r, g/2, b) in FIG. 6B, respectively.

When R, G, and B input image signals (as shown in FIG. 6A) are received, maximum and minimum signals "MAX" and "MIN" may be extracted from the R, G, and B input image signals. As shown in FIG. 6B, a line "0-1" is boundary of the CSS signal region and the GSS signal region. When "1" is (R, G)=(r/2, g), and value of B input image signal is between values of R and G input image signals, MAX=g, MIN=r/2, and MAX−2*MIN=g−2*(r/2)=r−2*(r/2)=0. Therefore, when R<r/2, input image signals may belong to the GSS signal region and there is MAX−2*MIN>0. When R≧r/2, input image signal may belong to the CSS signal region and there is MAX−2*MIN≦0.

Input image signals belonging to the CSS signal region are enlarged to the color space in RGBW arrangement according to the related art beyond in RGB arrangement. When the R, G, and B input image signals are amplified, the CSS signal region in FIG. 6A may be enlarged to a region surrounded by (0, 0, 0), (r, 2g, 2b), (2r, g, 2b), (2r, 2g, b), and (2r, 2g, 2b)(or 2w), and the CSS signal region in FIG. 6B may be enlarged to a region "0-f-2w-e".

While one part of input image signals belonging to the GSS signal region is enlarged to the color space in RGBW arrangement according to the related art beyond in the RGB arrangement, other part of input image signals belonging to the GSS signal region is enlarged to the color space in the RGBW arrangement according to the related art inside in RGB arrangement.

In FIG. 6B, as the color space in the RGBW arrangement according to the related art is a region "0-r-f-2w-e-g", regions "r-2r-f" and "g-2a-e" are the color space not embodied with the related art. Furthermore, regions A ("r-r'-j") and B ("g-g'-i") in the RGB arrangement do not belong to the color space in RGBW arrangement according to the related art.

The color space in the RGBW arrangement according to the related art is enlarged to regions C ("j-f-h") and D ("g-e-i"). Therefore, in one case a display device with the RGBW arrangement according to the related art is brighter than with the RGB arrangement, in other case is darker than with the RGB arrangement.

Therefore, in an embodiment of the present invention, input image signals may be converted differently and light luminance may be set differently when the input image signals are determined to have more signals belonging to the CSS signal region than the GSS region and when the input image signals are determined to have more signals belonging to the GSS region than the CSS region, to thereby generate the color space shown in FIGS. 5A and 5B.

Figure 7A:
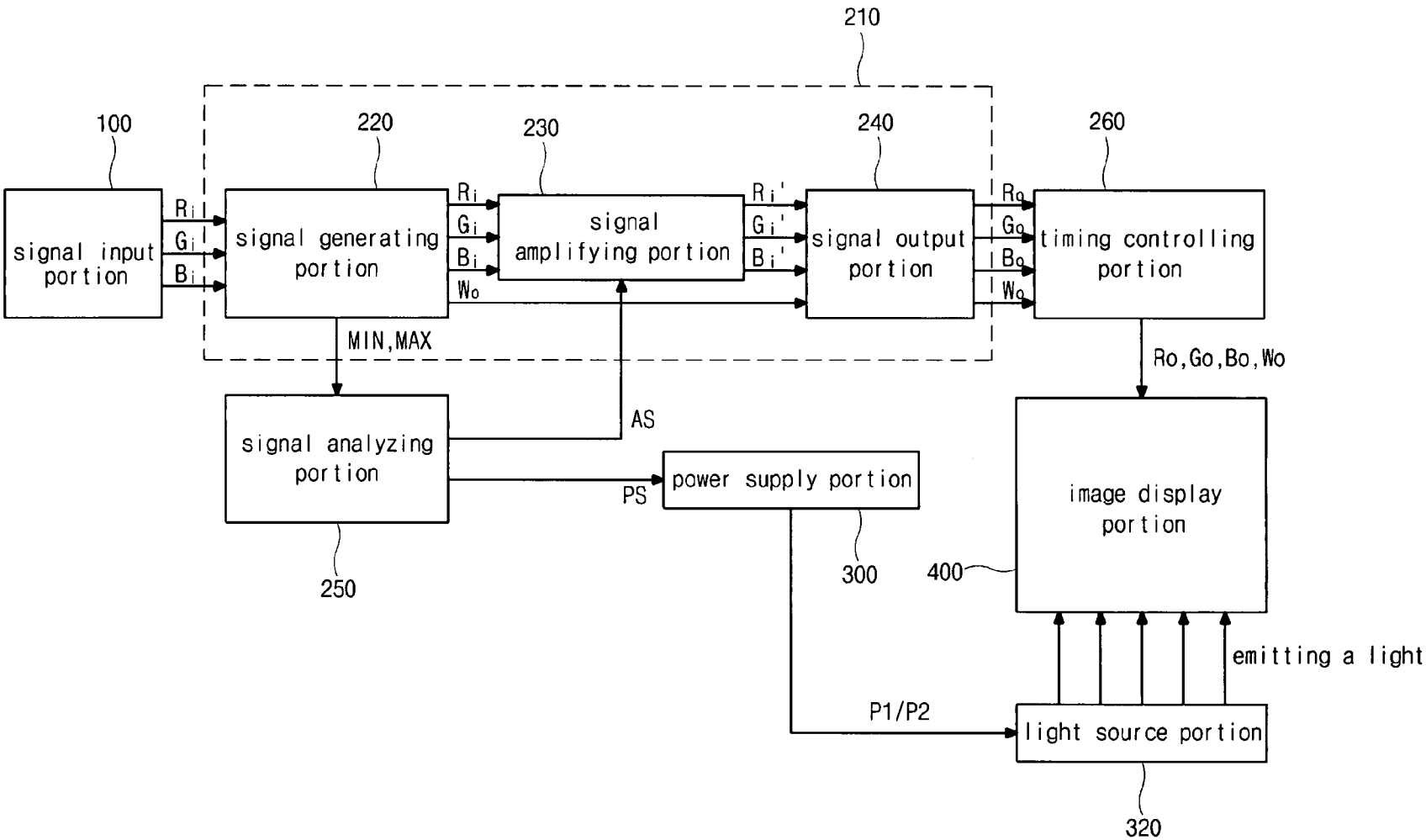
FIG. 7A is a schematic view of a display device embodying the color space according to an embodiment of the present invention.
Figure 7B:
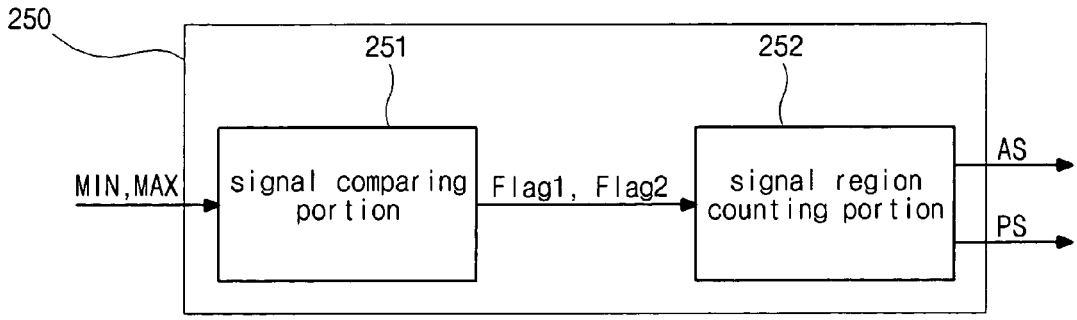
FIG. 7B is a schematic view of the signal analyzing portion in FIG. 7A according to an embodiment of the present invention.
Figure 8:
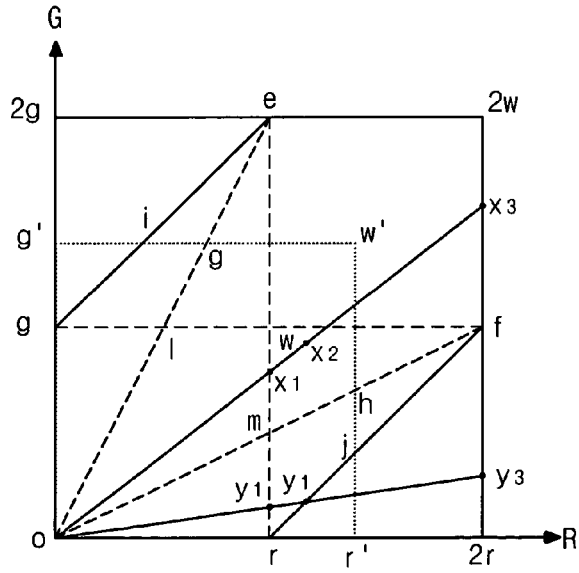
FIG. 8 is a view of method of embodying the color space according to an embodiment of the present invention.

FIG. 7A is a schematic view of a display device embodying the color space according to an embodiment of the present invention, FIG. 7B is a schematic view of signal analyzing portion in FIG. 7A according to an embodiment of the present invention, and FIG. 8 is a view of method of embodying the color space according to an embodiment of the present invention.

In FIG. 7A, a display device may include a signal input portion 100, a signal converting portion 210, a signal analyzing portion 250, a timing controlling portion 260, an image display portion 400, a light source portion 320, and a power supply portion 300. The power supply portion 300 may control brightness of light irradiated from the light source portion 320 to the image display portion 400. In addition, the image display portion 400 may include a liquid crystal panel, and include a plurality of pixels arranged in a matrix-like format. The pixels may be selectively driven based on image signals to control light transmittance of a liquid crystal layer in the pixels to display an image. Further, each of the pixels may include R, G, B, and W sub-pixels.

The signal converting portion 210 may receive input image signals, Ri, Gi, and Bi, from the signal input portion 100. The signal converting portion 210 may then convert the input image signals, Ri, Gi, and Bi, to output image signals, Ro, Go, Bo, and Wo. The signal converting portion 210 may include a signal generating portion 220, a signal amplifying portion 230, and a signal output portion 240.

The signal generating portion 220 may extract a white output image signal Wo, a maximum signal MAX, and a minimum signal MIN from the input image signals, Ri, Gi, and Bi. The signal converting portion 210 may apply the white output image signal Wo to the signal output portion 240, and may apply the maximum signal MAX and the minimum signal MIN to the signal analyzing portion 250. The white output image signal Wo may be the same as the minimum signal MIN, and the maximum signal MAX and the minimum signal MIN may be calculated using the following equations:

$$MIN=Min(Ri, Gi, Bi) \quad (1)$$

$$MAX=Max(Ri, Gi, Bi) \quad (2)$$

In addition, the signal analyzing portion 250 may determine whether the input image signal belongs to the CSS signal region or the GSS signal region (as shown in FIG. 6B) by analyzing the maximum signal MAX and the minimum signal MIN received from the signal generating portion 220. In addition, the signal analyzing portion 250 may analyze the number of input image signals belonging to the CSS signal region and belonging to the GSS signal region within the frame, respectively.

As shown in FIG. 7B, the signal analyzing portion 250 may include a signal comparing portion 251 and a signal region counting portion 252. The signal comparing portion 251 may compare the maximum signal MAX and the minimum signal MIN of the input image signals consecutively for a frame. For example, if it is determined that $(MAX-2*MIN)\leqq 0$ for an input image signal, the input image signal may be determined to belong to the CSS signal region. Then, the signal comparing portion 251 may provide a first flag signal Flag1 to the signal region counting portion 252, and the signal region counting portion 252 may then increase value of a first flag count signal by one.

However, if it is determined that $(MAX-2*MIN)>0$ for the input image signal, the input image signal may be determined to belong to the GSS signal region. Then, the signal comparing portion 251 may provide a second flag signal Flag2 to the signal region counting portion 252, and the signal region counting portion 252 may then increase value of a second flag count signal by one. As a result, the first and second flag count signals may respectively correspond to the number of input image signals belonging to the CSS signal region and belonging to the GSS signal region within the frame.

Further, the signal region counting portion 252 may compare the first and second flag count signals to generate an amplifying controlling signal AS and a power controlling signal PS. The amplifying controlling signal AS may be applied to the signal amplifying portion 230 and the power controlling signal may be applied to the power supply portion 300.

As shown in FIG. 7A, the signal amplifying portion 230 may amplify the input image signals, Ri, Gi, and Bi, based on the amplifying controlling signal AS. In particular, if the signal analyzing portion 250 determines that the input image signals, Ri, Gi, and Bi, include more signals belonging to the CSS signal region, i.e., the first flag count signal being higher than the second flag count signal, the signal amplifying portion 230 may amplify the input image signals, Ri, Gi, and Bi, by a first constant K1 using the following formula:

$$(Ri', Gi', Bi')=K1*(Ri, Gi, Bi) \quad (3)$$

The first constant K1 may be an integer and may equal to 2. As shown in FIG. 8, an input image signal "x1" belonging to the CSS signal region may be amplified by the first constant K1 to "x3" located along a boundary of the color space, e.g., a "2w-f" line. Therefore, input image signals belonging to the CSS signal region may be amplified by two-fold and be in the {0, f, 2w, e} region. Alternatively, the first constant K1 may be determined based on a desired value for "x3" using the following formula:

$$K1=(0-x3)/(0-x1) \quad (4)$$

Further, according to Formula 3 and when the first constant K1 equals to 2, an input image signal "y1" belonging to the GSS signal region would be amplified to a "y3" location along a "2r-f" line. However, since the "y3" location does not belong to the color space according to the related art when luminance of light emitted from the light source portion 320 (shown in FIG. 7A) is "Y3", the input image signal "y1" would at most be amplified to a "y2" location along a "r-f" line. As a result, when the input image signals, Ri, Gi, and Bi, are determined to include more signals belonging to the CSS signal region, the amplified image signals may be in the regions of {0, r, f}, {0, g, e}, and {0, f, 2w, e}.

Accordingly, when the input image signals, Ri, Gi, and Bi, are determined to include more signals belonging to the CSS signal region, the color space of the present invention may be the same as the color space of the related art. However, as input image signals belonging to the CSS signal region more frequently than to the GSS signal region, inequality of color luminance of images in the present invention is improved comparing to the related art.

Moreover, if the signal analyzing portion 250 (shown in FIG. 7A) determines that the input image signals, Ri, Gi, and Bi, include more signals belonging to the GSS signal region, i.e., the first flag count signal being less than the second flag count signal, the signal amplifying portion 230 (shown in FIG. 7) may amplify the input image signals, Ri, Gi, and Bi, by a second constant K2 using the following formula:

$$(Ri', Gi', Bi')=K2*(Ri, Gi, Bi) \quad (5)$$

As shown in FIG. 8, the input image signal "y1" belonging to the GSS signal region may be preferably amplified by the second constant K2 to the "y2" location because the "y2" location is located on the boundary of the color space in RGBW arrangement according to the related art, when luminance of light emitted from the light source portion 320 is "Y." As a result, the second constant K2 may be determined using the following formula:

$$K2=(0-y2)/(0-y1) \quad (6)$$

As luminance of the light emitted from the light source portion is converted from "Y" to "Y'", "y2" is moved to "y3." Since it is desired to have "y3" be located on a boundary of the color space of the present invention, e.g., a "2r-f" line, "Y" and "Y'" may be related as following expressions, Y'/Y=0-y3/0-y2. As a result, the input image signals belonging to the GSS signal region may be amplified and luminance of the light emitted from the light source portion may be converted, regions "0-2r-f", and "0-2g-e" are embodied.

An input image signal "x1" belonging to the CSS signal region may be amplified by K2 to "x2", and "x2" may then be moved to "x3" by amplifying luminance of the light emitted from the light source portion, thereby the region "0-f-2w-e" embodied.

When the input image signals, Ri, Gi, and Bi, are determined to include more signals belonging to the GSS signal region, the color space may be the region {0, 2r, 2w, 2g}. Therefore, inequality of color luminance is compensated by amplifying luminance of the light emitted from the light source portion.

The first and second constants K1 and K2 may be related to luminance of light "Y" and "Y'" as shown in the following expressions:

$$K1=(0-x3)/(0-x1)=(0-y3)/(0-y1)=[(0-y3)/(0-y2)]*[(0-y2)/(0-y1)]$$

Because Y'/Y=(0-y3)/(0-y2), and K2=(0-y2)/(0-y1), K1=(Y'/Y)*K2. That is, K1*Y=K2*Y.

The signal output portion 240 (shown in FIG. 7) may provide the output image signals, Ro, Go, and Bo, by subtracting "Wo" from "Ri'", "Gi'", and "Bi'", respectively. The signal output portion 240 may use the following formula:

$$(Ro, Go, Bo)=(Ri, Gi, Bi)-Wo \quad (7)$$

In addition, the power supply portion 300 (shown in FIG. 7) may provide a power to the light source portion 320 in accordance with the power controlling signal PS. When the input image signals, Ri, Gi, and Bi, include more signals belonging to the CSS signal region, i.e., the first flag count signal being higher than the second flag count signal, the power supply portion 300 may provide a first power P1 to the light source portion 320. When the input image signals, Ri, Gi, and Bi, include more signals belonging to the GSS signal region, i.e., the first flag count signal being less than the second flag count signal, the power supply portion 300 may provide a second power P2 to the light source portion 320. The power supply portion 300 may include an inverter.

Further, the light source portion 320 may irradiate light having "Y" luminance if the first power P1 is received. In addition, the light source portion 320 may irradiate light having "Y'" luminance if the second power P2 is received.

Moreover, the timing controlling portion 260 (shown in FIG. 7) may synchronize and provide the output image signals, Ro, Go, Bo, and Wo, to the image display portion 400 (shown in FIG. 7) based on a timing control signal (not shown). As a result, R, G, B, and W sub-pixels of the image display portion 400 may be driven in accordance with the output image signals, Ro, Go, Bo, and Wo.

The above-described embodiment of the present invention improves inequality of color luminance by comparing frequencies of input image signals belonging to the CSS signal region and the GSS signal region and by amplifying input image signals and luminance of the light emitted from the light source differently. In addition, the above-described embodiment of the present invention provides red, green, blue, and white light having a same luminance.

It will be apparent to those skilled in the art that various modifications and variations can be made in the display device and the driving method thereof of the present invention without departing from the spirit or scope of the invention. Thus, it is intended that the present invention covers the modifications and variations of this invention provided they come within the scope of the appended claims and their equivalents.

What is claimed is:

1. A display device, comprising:

a signal analyzing portion categorizing a plurality of image signals, each of which includes red-color, green-color, and blue-color signals, as belonging to one of first and second signal regions, and detecting if a number of image signals out of the plurality of image signals belonging to the first signal region is more than that belonging to the second signal region or if a number of image signals out of the plurality of image signals belonging to the second signal region is more than that belonging to the first signal region; and means for driving an image display portion in a first manner if the number of image signals out of the plurality of image signals belonging to the first signal region is more than that belonging to the second signal region, and driving the image display portion in a second manner if the number of image signals out of the plurality of image signals belonging to the second signal region is more than that belonging to the first signal region, the image display portion including a plurality of pixels, each of the pixels having red-color, green-color, blue-color, and white-color sub-pixels, the pixels corresponding to the image signals, wherein driving the image display portion in the first manner includes amplifying the plurality of image signals and emitting light having a first luminance to the image display portion, and driving the image display portion in the second manner includes amplifying the plurality of image signals and emitting light having a second luminance to the image display portion, the first and second signal regions being a constant scaling space (CSS) signal region and a gamut scaling space (GSS) signal region, respectively, the first luminance less than the second luminance.

2. The device according to claim 1, wherein the means for driving comprises:

a signal converting portion amplifying the plurality of image signals by a first value if the number of image signals out of the plurality of image signals belonging to the first signal region is more than that belonging to the second signal region, and amplifying the image signals by a second value if the number of image signals out of the plurality of image signals belonging to the second signal region is more than that belonging to the first signal region.

3. The display device according to claim 2, wherein the signal converting portion comprises:

a signal generating portion generating a white-color image output signal based on the red-color, green-color, and blue-color signals;

a signal amplifying portion receiving an amplifying controlling signal from the signal analyzing portion and amplifying the red-color, green-color, and blue-color signals based on the amplifying controlling signal and generating amplified red-color, green-color, and blue-color signals; and a signal output portion receiving the white-color image output signal, and the amplified red-color, green-color, and blue-color signals and generating red-color, green-color, and blue-color image output signals.

4. The display device according to claim 3, wherein the white-color image output signal is a minimum value among values of the red-color, green-color, and blue-color signals.

5. The display device according to claim 3, wherein the red-color, green-color, and blue-color image output signals are generated by subtracting value of the white-color image output signal from the amplified red-color, green-color, and blue-color signals, respectively.

6. The display device according to claim 3, further comprising a timing controlling portion synchronizing and outputting the red-color, green-color, blue-color, and white-color image output signals to the image display portion.

7. The device according to claim 2, further comprising:

a light emitting portion emitting light to the image display portion having the first luminance if the number of image signals out of the plurality of image signals belonging to the first signal region is more than that belonging to the second signal region, and emitting light having the second luminance if the number of image signals out of the plurality of image signals belonging to the second signal region is more than that belonging to the first signal region.

8. The display device according to claim 7, wherein the light emitting portion is driven with a first power if the number of image signals out of the plurality of image signals belonging to the first signal region is more than that belonging to the second signal region, and the light emitting portion is driven with a second power if the number of image signals out of the plurality of image signals belonging to the second signal region is more than that belonging to the first signal region.

9. The display device according to claim 7, wherein (the first value * the first luminance)=(the second value * the second luminance).

10. The display device according to claim 9, wherein the first value equals to two.

11. The display device according to claim 1, wherein the signal analyzing portion comprises a signal comparing portion comparing a MAX signal with a MIN signal to categorize the image signals as belonging to one of the first and second signal regions, wherein the MAX and MIN signals are maximum and minimum of values of the red-color, green-color and blue-color signals.

12. The display device according to claim 11, wherein the signal comparing portion outputs a Flag1 signal if MAX−2*MIN ≦0 and outputs a Flag2 signal if MAX−2*MIN >0 to a signal count portion.

13. A method of driving a display device, comprising:

categorizing a plurality of image signals, each of which includes red-color, green-color, and blue-color signals, as belonging to one of first and second signal regions;

detecting if a number of image signals out of the plurality of image signals belonging to the first signal region is more than that belonging to the second signal region or if a number of image signals out of the plurality of image belonging to the second signal region is more than that belonging to the first signal region;

driving an image display portion in a first manner if the number of image signals out of the plurality of image signals belonging to the first signal region is more than that belonging to the second signal region, the image display portion including a plurality of pixels, each of the pixels having red-color, green-color, blue-color, and white-color sub-pixels, the pixels corresponding to the image signals; and driving the image display portion in a second manner if the number of image signals out of the plurality of image signals belonging to the second signal region is more than that belonging to the first signal region, wherein driving the image display portion in the first manner includes amplifying the image signals and emitting light having a first luminance to the image display portion, and driving the image display portion in the second manner includes amplifying the image signals and emitting light having a second luminance of a light emitted to the image display portion, the first and second signal regions being a constant scaling space (CSS) signal region and a gamut scaling space (GSS) signal region, respectively, the first luminance less than the second luminance.

14. The method according to claim 13, wherein the step of driving the image display portion comprises:

amplifying the plurality of image signals by a first value if the number of image signals out of the plurality of image signals belonging to the first signal region is more than that belonging to the second signal region; and amplifying the image signals by a second value if the number of image signals out of the plurality of image signals belonging to the second signal region is more than that belonging to the first signal region.

15. The method according to claim 14, wherein the step of driving the image display portion further comprises:

generating a white-color image output signal based on the red-color, green-color, and blue-color signals; and generating red-color, green-color, and blue-color image output signals based on the amplified red-color, green-color, and blue-color signals.

16. The method according to claim 15, wherein the step of generating the red-color, green-color, and blue-color image output signals comprises subtracting value of the white-color image output signal from the amplified red-color, green-color, and blue-color signals, respectively.

17. The method according to claim 14, further comprising setting (the first value * the first luminance) equal to (the second value * the second luminance).

18. The method according to claim 17, further comprising setting the first value equal to two.

19. The method according to claim 13, wherein the step of categorizing the image signals comprises comparing a MAX signal with a M1N signal, wherein the MAX and MIN signals are maximum and minimum of values of the red-color, green-color, and blue-color signals.

20. The method according to claim 19, further comprising:

outputting a Flag1 signal if MAX−2*MIN≦0 to a signal count portion; and outputting a Flag2 signal if MAX−2*MIN>0 to the signal count portion.

* * * * *